US007762196B1

(12) United States Patent
Fu

(10) Patent No.: US 7,762,196 B1
(45) Date of Patent: Jul. 27, 2010

(54) MUNITION CONTAINING SUB-MUNITIONS THAT DISPERSE IN A CIRCULAR DELTA GRID IMPACT PATTERN AND METHOD THEREFOR

(75) Inventor: Jyun-Horng Fu, Linden Creek Ct., VA (US)

(73) Assignee: Lockheed Martin Corporation, Bethesda, MD (US)

( * ) Notice: Subject to any disclaimer, the term of this patent is extended or adjusted under 35 U.S.C. 154(b) by 326 days.

(21) Appl. No.: 12/102,779

(22) Filed: Apr. 14, 2008

Related U.S. Application Data

(60) Provisional application No. 60/911,416, filed on Apr. 12, 2007.

(51) Int. Cl.
*F42B 39/26* (2006.01)

(52) U.S. Cl. ..... 102/489

(58) Field of Classification Search ..... 102/489, 102/494, 491, 492, 497, 475; 86/47, 48, 86/1.1; 89/197, 33.02, 33.01
See application file for complete search history.

(56) References Cited

U.S. PATENT DOCUMENTS 1,504,714 A * 8/1924 Russell et al. ..... 89/33.14
2,343,818 A * 3/1944 Sweeley ..... 102/454
3,093,072 A * 6/1963 Pigman ..... 102/393
3,464,356 A * 9/1969 Salzman et al. ..... 102/489
4,231,293 A * 11/1980 Dahn et al. ..... 102/393
4,616,567 A * 10/1986 Romer et al. ..... 102/489
4,638,736 A * 1/1987 Farmer ..... 102/393
4,960,055 A * 10/1990 Dieval ..... 102/489
5,076,171 A * 12/1991 Altenau et al. ..... 102/489
5,107,767 A * 4/1992 Schneider et al. ..... 102/393
5,191,169 A * 3/1993 Hu ..... 102/476
7,017,496 B2 * 3/2006 Lloyd ..... 102/494
7,040,235 B1 * 5/2006 Lloyd ..... 102/489
7,261,039 B1 * 8/2007 Bittle et al. ..... 102/489
7,494,090 B2 * 2/2009 Leal et al. ..... 244/3.16
2003/0172833 A1 * 9/2003 Ronn et al. ..... 102/489
2005/0066838 A1 * 3/2005 Doughty ..... 102/357
2008/0307994 A1 * 12/2008 Gustafsson et al. ..... 102/489

* cited by examiner

*Primary Examiner*—Michael Carone
*Assistant Examiner*—Reginald Tillman, Jr.
(74) *Attorney, Agent, or Firm*—DeMont & Breyer, LLC

(57) ABSTRACT

A method is disclosed for packaging sub-munitions within stacks of same, in a cylindrical payload space, such that the sub-munitions emerge into a circular delta grid pattern when deployed.

8 Claims, 5 Drawing Sheets

Stack 1

Stacks 1 & 2

Stacks 1, 2, & 3

Stack 1

Stacks 1 & 2

Stacks 1, 2 & 3

Stacks 1, 2, 3 & 4

MUNITION CONTAINING SUB-MUNITIONS THAT DISPERSE IN A CIRCULAR DELTA GRID IMPACT PATTERN AND METHOD THEREFOR

STATEMENT OF RELATED CASES

This case claims priority of U.S. Provisional Patent Application 60/911,416, which was filed on Apr. 12, 2007 and is incorporated by reference herein.

FIELD OF THE INVENTION

The present invention relates to packaging and dispensing sub-munitions.

BACKGROUND OF THE INVENTION

Current approaches to beach and surf zone mine clearance depend on the dispensing of large numbers of sub-munitions from a parent munition (e.g., a missile, etc.). The mine clearance mission requires a uniform distribution of sub-munitions, such as "darts," over the target area. The dispersal pattern is affected by many factors, including the angle of attack, velocity, and rotational rate of the parent vehicle, the aerodynamic design of the darts, dart collision, and the different aerodynamic regimes that exist in the vicinity of the parent munition.

It has been recognized that it is particularly effective, for mine clearance operations, to deploy darts in a simple geometric pattern called a circular delta grid ("CDG") pattern. In a CDG pattern, nodes form an equilateral triangle (delta), with a circular perimeter. In the context of mine clearance and sub-munitions, the CDG pattern is a pattern in which the nearest three sub-munitions form an equilateral triangle and collectively all projectiles form a circle of tightest coverage, the radius of which is determined by the total number of darts in the payload.

Although the desirability of deploying the darts in a CDG pattern is recognized, there is an issue as to how to package the darts in a cylindrical payload space such that, when dispensed, the "darts" emerge and impact in the CDG pattern. In fact, the problem is complicated by the fact that typically, there will be multiple stacks of darts within the payload space.

SUMMARY

The invention provides the solution to the packaging issue posed above.

The illustrative embodiment of the present invention is a packaging method. Consider a payload cylinder that receives a number, S, of layers of projectiles, such as the counter-mine darts disclosed in U.S. Provisional Patent Application 60/985,516, filed Nov. 5, 2007 and incorporated by reference herein. Each layer includes the same number, N, of projectiles.

Assume one of the layers is centered (i.e., co-axial) with the payload cylinder. Beginning from the center of an equilateral triangle, define three 120-degree sectors. The inventor has determined that if N is of the form ($3^p \times 4^q$), then by off-setting the remaining (S−1) layers in certain ways, the total of number of projectiles (i.e., N×S) generates a CDG pattern upon dispersion.

There are two arrangements that satisfy the requirement for the CDG pattern. One arrangement comprises three layers and the other arrangement comprises four layers. Based on a 1-unit spacing between adjacent projectiles in a given layer, the spacing between adjacent projectiles over the three-layer pattern is $1/(3^{1/2})$ units and the spacing between adjacent projectiles over the four-layer pattern in ½ units. Multiple groupings of three-layer bunches or four-layer bunches can be contained within a payload cylinder in accordance with the formula: $S=3^p \times 4^q$, wherein p and q are integers.

In some embodiments, delays are artificially created so that the radial distances of the sub-munitions are as designed.

The illustrative embodiment provides what is believed to be the only solution to this packaging/dispensing problem. The solution also indicates how to integrate the payload geometric configuration with other design considerations.

Recasting the illustrative embodiment of the present invention as a dispersion pattern rather than a packaging pattern, as in the sequential "filling into the middles," an alternative concept of operations for mine clearance is obtained. That is, for a target-defeat mission that employs sub-munitions, the radius of coverage can be established at a relatively large value. The "middle" is filled (i.e., the projectile dispersion density is increased by increasing the number of layers of sub-munitions), only after an attempt to hit/kill fails. This conserves the number of payload rounds, sorties, etc., that are required. This is feasible, of course, only if the target is not moving, as is the case in most mine clearance operations.

DETAILED DESCRIPTION

The present invention provides a way to pack sub-munitions, such as counter-mine darts, in a parent munition such that they when impact a target area, they do so in a circular delta grid (CDG) pattern. Only certain packing arrangements will yield a CDG pattern on deployment of the sub-munitions.

Figure 1:
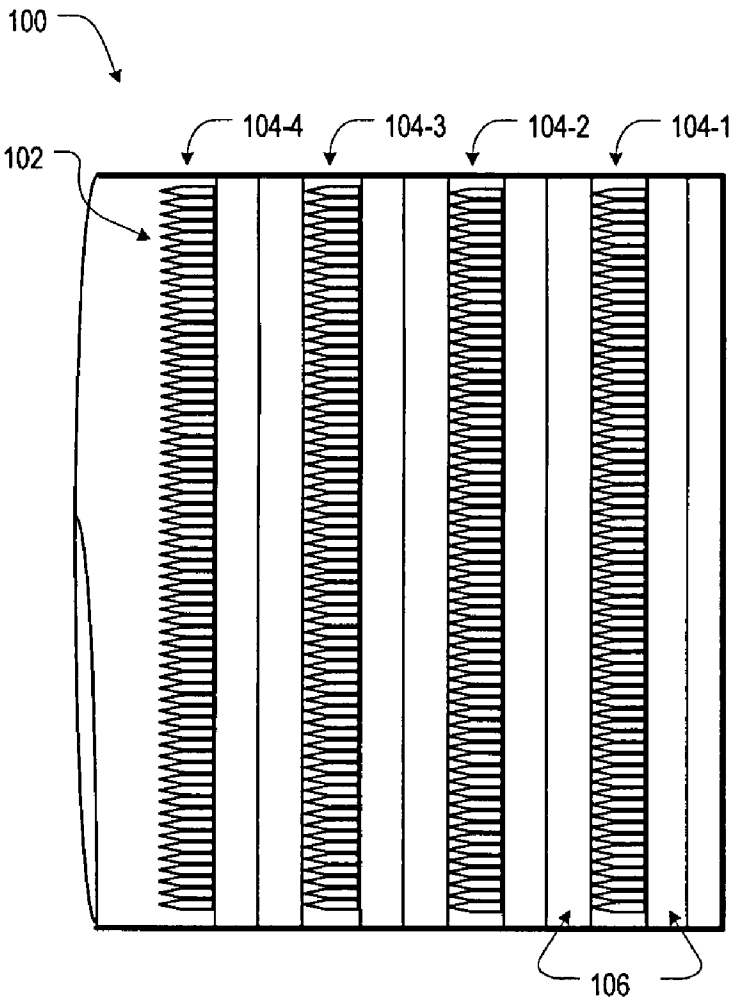
FIG. 1 depicts a side view of the payload of munition, wherein the payload comprises a plurality of layers of sub-munitions arranged in a stack in accordance with the illustrative embodiment of the present invention.

FIG. 1 depicts munition 100 containing a plurality of sub-munitions 102. The sub-munitions are arranged into a plurality of layers 104-1, 104-2, 104-3, and 104-4. Each layer is separated from one another, and the sub-munitions therein are contained, by separators 106. The separators can provide an adjustable delay between successive layers of munitions, such as by changing the thickness of the separators.

Figure 2:
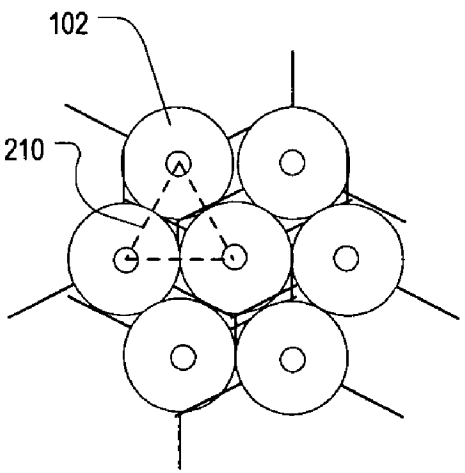
FIG. 2 depicts an enlarged view of FIG. 1, showing the arrangement of several sub-munitions within one of the layers.

FIG. 2 depicts several of sub-munitions 102 from a given layer packed in such a manner that any three nearest sub-munitions fall on the vertices of equilateral triangle 210.

Figure 3:
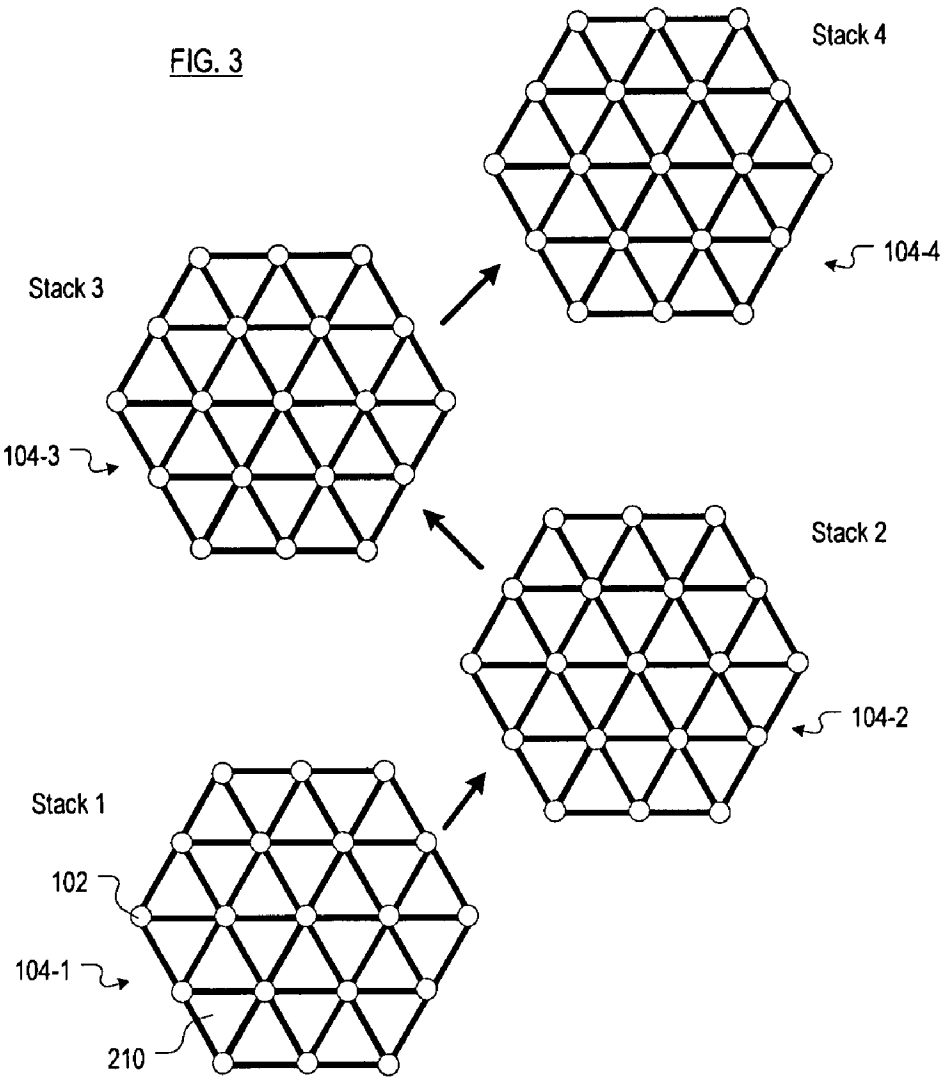
FIG. 3 depicts the concept of organizing a plurality of layers into a stack of sub-munitions.
Figure 4:
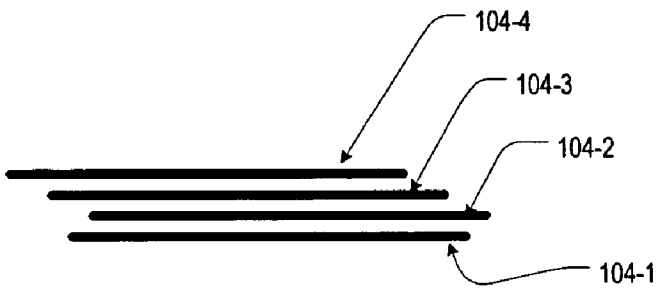
FIG. 4 depicts the stacks of sub-munitions shown in FIG. 3 overlying one another, wherein each stack is slightly offset from the other stacks in accordance with the present teachings.

FIGS. 3 and 4 depict, figuratively, the stacking of four layers 104-1, 104-2, 104-3, and 104-4 of sub-munitions. Each sub-munition 102 in each layer falls on the vertex of equilateral triangle 210, as per FIG. 2. FIG. 4 depicts the offsetting of each layer relative to the other layers to develop a CDG pattern on dispersal.

Figures 5A, 5B, 5C:
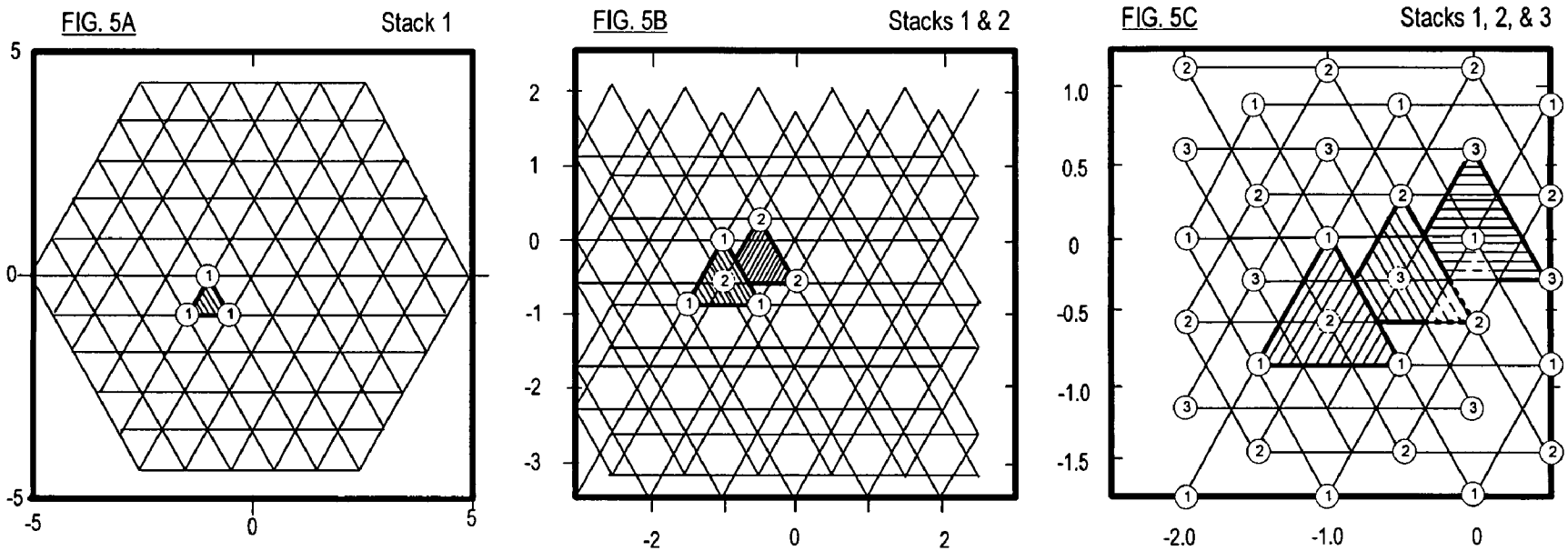
FIGS. 5A through 5C depict the sequential stacking of three layers of sub-munitions, wherein the spacing between nearest sub-munitions across all three layers is $1/(3)^{1/2}$ units.

As in indicated in the Summary section, layers can be stacked only in groups of three or four to achieve a CDG pattern on dispersal. FIGS. 5A through 5C depict the three-layer grouping of sub-munitions. The arrangement of munitions within each layer is identical; they all fall on the vertices of an equilateral triangle of unit size. But, as is apparent from the FIGS. 5A-5C, the layers are offset from one another in a particular way.

FIG. 5A depicts a first layer of sub-munitions, wherein a sub-munition is assumed to present at all vertices. An illustrative grouping is depicted in FIG. 5A, wherein the "1" that appears at the three vertices is meant to signify that these vertices are occupied by a munition from layer-1.

FIG. 5B depicts a second layer of sub-munitions slightly offset from the first layer. In particular, a vertex (sub-munition) is positioned to be in the center of equilateral triangle formed by layer-1 sub-munitions. The illustrative grouping representative of the munitions from the first layer as shown in FIG. 5A is reproduced in the same location in FIG. 5B for reference. Using only two layers would not result in a CDG impact pattern; for that, an additional layer must be added for the offset selected.

FIG. 5C depicts a third layer of sub-munitions offset from the second layer in the same manner as the second layer is offset from the first layer. That is, a vertex from a layer-3 triangular grouping falls in the center of a layer-2 triangular grouping. The illustrative groupings for layers one and two that were shown in FIG. 5B are reproduced in FIG. 5C in the same location for reference. Note that the scale changes across the three Figures to resolve the amount of the offset between the three layers.

Assuming a unit distance between adjacent sub-munitions in any given layer, the three-layer stack provides a distance of $1/(3^{1/2})$ units. In other words, if the unit spacing is 1 meter between adjacent sub-munitions in any given layer, the spacing between adjacent sub-munitions in the impact grid (assuming no dispersal) is about 0.58 meters. The spacing between sub-munitions at impact (assuming no dispersal) is referred to in this description and the appended claims as "impact spacing."

FIGS. 6A through 6D depict the four-layer grouping of sub-munitions in accordance with the present invention. The layers in the four-layer grouping are offset in a different manner than in the three-layer grouping.

Figure 6A:
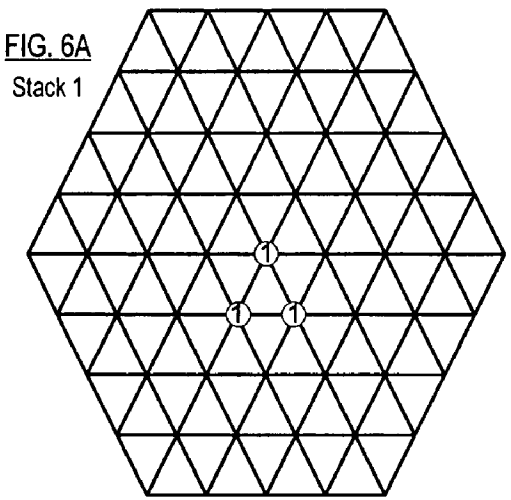
FIGS. 6A through 6D depict the sequential stacking of four layers of sub-munitions, wherein the spacing between adjacent sub-munitions in each layer ½ of a unit.

FIG. 6A depicts a first layer of sub-munitions, wherein a sub-munition is assumed to present at all vertices. An illustrative grouping is depicted in FIG. 6A, wherein the "1" that appears at the three vertices is meant to signify that these vertices are occupied by a munition from layer 1.

Figure 6B:
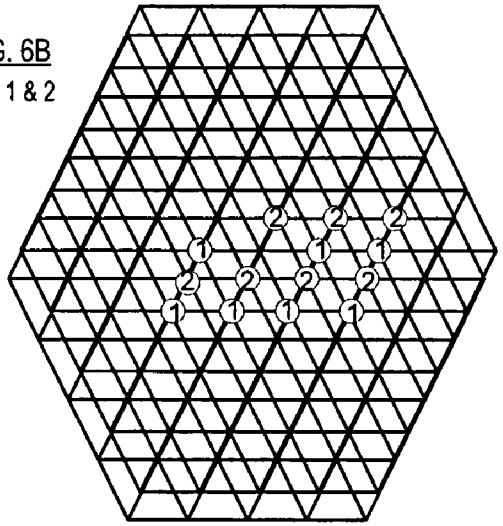

FIG. 6B depicts a second layer that is slightly offset from the first layer. In particular, layer-2 is offset by positioning a vertex (sub-munition) at the mid-point of one of the sides of an equilateral triangular grouping formed in layer-1. The locations of several representative munitions from the two layers are identified (by the numerals "1" and "2") to highlight their relative positions. Reference to this Figure shows that after two layers, a CDG pattern has not developed. That is, all nearest neighbors do not fall on vertices of an equilateral triangle. The notation for one of the layer-1 munitions is omitted to make it easier to recognize the unit size equilateral triangular arrangement of layer-2 munitions.

Figure 6C:
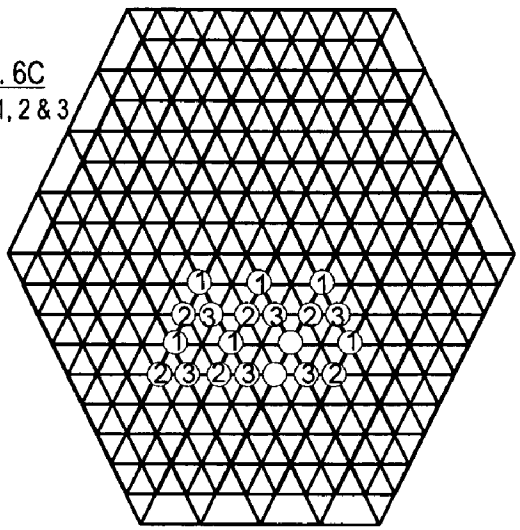

FIG. 6C depicts the third layer slightly offset from layers 1 and 2 by positioning a vertex (sub-munition) at the mid-point of one of the other sides of an equilateral triangular grouping formed in layer-1. Reference to FIG. 6C shows the now each layer-1 triangular arrangement has a layer-2 munition superposed at the midpoint between one of its sides and a layer-3 munition that is superposed at the midpoint between a second of its sides. It is clear that there is a "gap" that remains; that is, an additional munition must be superposed at the midpoint of the third side of the triangular to complete the CDG pattern. This is done by adding a fourth layer. The notations for one of the layer-1 sub-munitions and one of the layer-2 sub-munitions are omitted to make it easier to recognize the unit size equilateral triangular arrangement of layer-3 munitions.

Figure 6D:
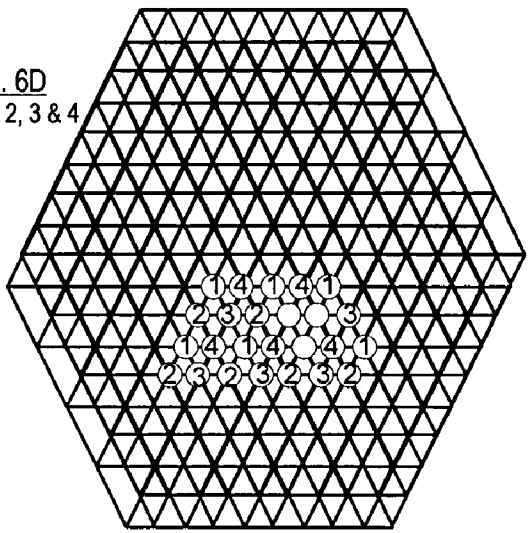

FIG. 6D depicts the fourth layer slightly offset from layers 1-3 by superposing a vertex (sub-munition) at the midpoint of the third and final side of a layer-1 triangular arrangement. As is clear from FIG. 6D, the superposition of these four layers fills the pattern to create the desired CDG arrangement. Again, the identifier for a representative sub-munition from each of the layers 1-3 is omitted to illustrate the unit size equilateral triangular arrangement of layer-4 munitions.

Thus, FIGS. 5A through 5C depict the manner in which a three-layer stack is arranged to create a CDG impact pattern. Likewise, FIGS. 6A through 6D depict the manner in which a four-layer stack is arranged to create a CDG impact pattern. When more than a single layer of sub-munitions are required (for coverage, etc.), only three-layer "stacks" and four-layer "stacks," arranged as shown, will create the desired CDG impact pattern.

Notwithstanding the fact that one "three-layer" stack or one "four-layer" stack of sub-munitions will provide the desired CDG pattern, two such stacks will not. In fact, the inventor has discovered that to yield the desired impact pattern, the number of layers of sub-munitions within a canister must obey the relation:

$$S=3^p\times 4^q, \text{ wherein p and q are integers} \quad [1]$$

Canisters must include either three-layer stacks or four-layer stacks. The "3" in expression [1] refers to three-layer stacks and the "4" refers to four-layer stacks. So, if a munitions canister includes three-layer stacks, then q=0, so that $S=3^p\times 1$. Likewise, if a munitions canister includes four-layer stacks, then p=0, so that $S=1\times 4^q$.

The allowed arrangements can therefore be viewed as being "recursive." That is, allowed arrangements (i.e., permissible total number of layers) for three-layer stacks are:

$3^p=3$ (p=1), which is one, three-layer stack;

$3^p=9$ (p=2), which is three, three-layer stacks;

$3^p=27$ (p=3), which is nine (3×3), three-layer stacks; and so forth.

Similarly, the allowed arrangements for four-layer stacks are:

$4^q=4$ (q=1), which is one, four-layer stack;

$4^q=16$ (q=2), which is four, four-layer stacks;

$4^q=64$ (q=3), which is sixteen (4×4), four-layer stacks; and so forth.

Figure 7:
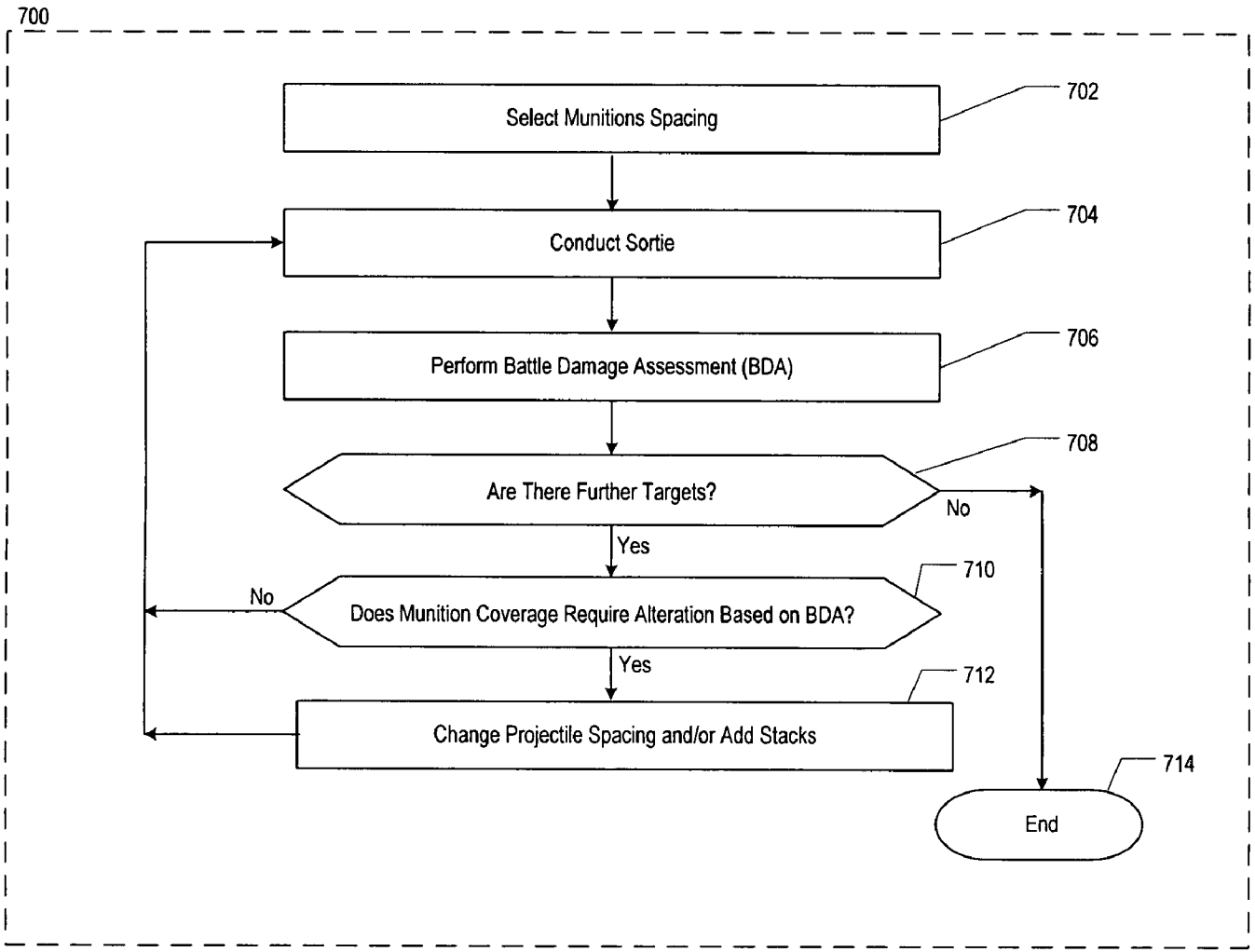
FIG. 7 depicts a method in accordance with the present invention for conducting target defeat sorties.

The packaging approach described above leads to a methodology for mine clearance, embodied as method 700 depicted in FIG. 7.

In accordance with operation 702 of the method, the spacing between adjacent sub-munitions (in a layer) is selected. A sortie is conducted, as per operation 704, and a "battle damage assessment" or BDA is performed in operation 706.

If there are no further targets, then the method terminates at operation 714. If, on the other hand, targets remain, a decision is made as to whether the munitions coverage should be altered based on the BDA. If the BDA indicates that coverage is acceptable, then a subsequent sortie is then conducted.

If the BDA indicates that coverage is unacceptable, a decision is made, in accordance with operation 712, to increase the density of coverage. This can be done by decreasing the spacing between sub-munitions (if possible) or, alternatively, by increasing the layers of sub-munitions in the parent munition in accordance with the packaging methodology previously presented. After altering the packaging density, a subsequent sortie is conducted.

It is to be understood that the disclosure teaches just one example of the illustrative embodiment and that many variations of the invention can easily be devised by those skilled in the art after reading this disclosure and that the scope of the present invention is to be determined by the following claims.

What is claimed is:

1. A method for packaging sub-munitions, wherein the method comprises:

providing at least one stack of sub-munitions, wherein the stack comprises a plurality of layers of sub-munitions, wherein the sub-munitions in each of the layers are arranged so that any three adjacent sub-munitions within a given layer are arranged in the form an equilateral triangle, and wherein the stack is selected from the group consisting of a three-layer stack containing three layers of sub-munitions and a four layer stack containing four layers of sub-munitions; and offsetting each of the layers within the selected stack from all other layers in the stack, wherein:

(a) when the three-layer stack is selected:

(i) establishing a location for a first of the three layers;

(ii) offsetting a second of the three layers relative to the first so that a sub-munition from the second layer superposes a center of a first equilateral triangle formed by three sub-munitions from the first layer; and (iii) offsetting a third of the three layers relative to the second so that a sub-munition from the third layer superposes a center of the first equilateral triangle; and (b) when the four-layer stack is selected:

(i) establishing a location for a first of the four layers;

(ii) offsetting a second of the four layers relative to the first so that a sub-munition from the second layer superposes a midpoint of a first side of a second equilateral triangle formed by three sub-munitions from the first layer;

(iii) offsetting a third of the four layers relative to the first so that a sub-munition from the third layer superposes a midpoint of a second side of the second equilateral triangle;

(iv) offsetting a fourth of the four layers relative to the first so that a sub-munition from the fourth layer superposes a midpoint of a third side of the second equilateral triangle.

2. The method of claim 1 wherein the total number of layers, S, obeys the relation: $S=3^p\times4^q$, wherein p and q are integers and wherein 3 represents the three-layer stack and 4 represents the four-layer stack.

3. The method of claim 1 wherein when a spacing between nearest sub-munitions in a given layer of the three-layer stack is one unit, the impact spacing between nearest sub-munitions from the three-layer stack is $1/(3)^{1/2}$ units.

4. The method of claim 1 wherein when a spacing between nearest sub-munitions in a given layer of the four-layer stack is one unit, the impact spacing between nearest sub-munitions from the four-layer stack is ½ units.

5. The method of claim 1 wherein the sub-munition is a counter-mine dart.

6. A method for packaging sub-munitions, wherein the method comprises:

providing at least one stack of sub-munitions, wherein the stack comprises a plurality of layers of sub-munitions, wherein the sub-munitions in each of the layers are arranged so that any three adjacent sub-munitions within a given layer are arranged in the form an equilateral triangle, and wherein the stack is selected from the group consisting of a three-layer stack containing three layers of sub-munitions and a four layer stack containing four layers of sub-munitions; and offsetting each of the layers within the selected stack from all other layers in the stack so that:

(a) the impact spacing from the three-layer stack is $1/(3)^{1/2}$ units based on a spacing of one unit between nearest sub-munitions in a given layer of the three-layer stack; and (b) the impact spacing from the four layer stack is ½ units based on a spacing of one unit between nearest sub-munitions in a given layer of the four-layer stack.

7. The method of claim 5 wherein the total number of layers, S, obeys the relation: $S=3^p\times4^q$, wherein p and q are integers and wherein 3 represents the three-layer stack and 4 represents the four-layer stack.

8. The method of claim 6 wherein the sub-munition is a counter-mine dart.

* * * * *